US005249692A

United States Patent [19]

Gunderson

[11] Patent Number: 5,249,692

[45] Date of Patent: Oct. 5, 1993

[54] VAPOR SEAL

[76] Inventor: Roger Gunderson, 33191 Paseo Mono, San Juan Capistrano, Calif. 92675

[21] Appl. No.: 925,447

[22] Filed: Aug. 10, 1992

[51] Int. Cl.[5] ..... B65D 88/34

[52] U.S. Cl. ..... 220/216; 220/578; 383/4; 383/121.1; 383/907

[58] Field of Search ..... 220/216, 225, 232, 578; 383/4, 104, 121.1, 907, 901; 128/403

[56] References Cited

U.S. PATENT DOCUMENTS

| | | | |
|---|---|---|---|
| 2,343,512 | 3/1944 | Lobl | 383/907 X |
| 3,072,920 | 1/1963 | Yellott | 220/216 X |
| 3,135,415 | 6/1964 | Fino | 220/225 |
| 3,154,213 | 10/1964 | Ulm | 220/225 |
| 4,383,564 | 5/1983 | Hoie | 383/907 X |
| 4,401,306 | 8/1983 | Arnold | 220/225 X |
| 4,413,747 | 11/1983 | Tenold et al. | 220/216 X |
| 4,552,090 | 11/1985 | Coleman | 220/578 X |
| 4,844,286 | 7/1989 | Jacobson | 383/121.1 X |
| 4,930,644 | 6/1990 | Robbins, III | 383/121.1 X |

*Primary Examiner*—Allan N. Shoap
*Assistant Examiner*—Paul Schwarz
*Attorney, Agent, or Firm*—Stetina and Brunda

[57] ABSTRACT

A vapor seal for use in a container holding an air curable liquid for preventing the surface of the liquid from being exposed to air to eliminate skinning thereon when the container is stored in a partially full state. The vapor seal generally comprises a support member having a seal member attached thereto and extending radially outward therefrom. The seal member defines a peripheral edge and a lower, liquid contacting surface, and is sized and configured such that the peripheral edge is abutted and sealed against the inner surface of the container when the lower surface is floated upon the surface of the liquid. The vapor seal further includes a handle member which is attached to and extends upwardly from the top surface of the support member for inserting the vapor seal into and removing the vapor seal from within the container.

3 Claims, 2 Drawing Sheets

Fig. 1
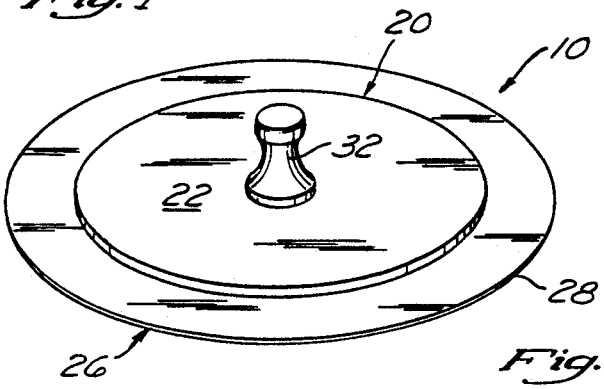
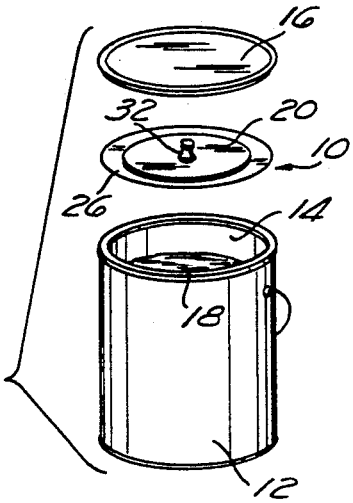
Fig. 2
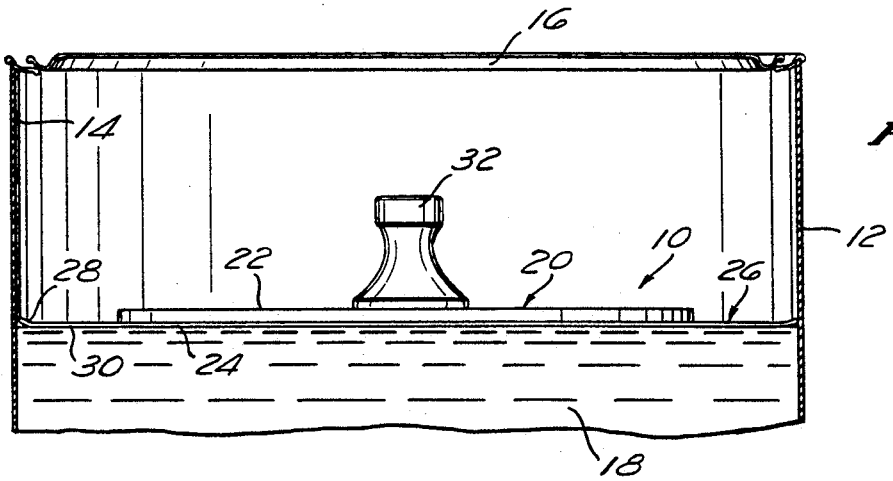
Fig. 3
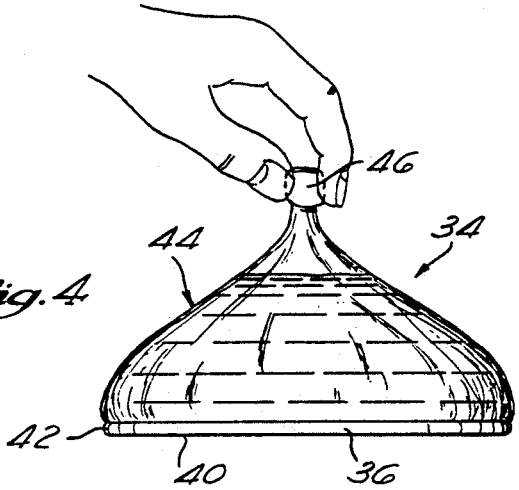
Fig. 4
Fig. 5
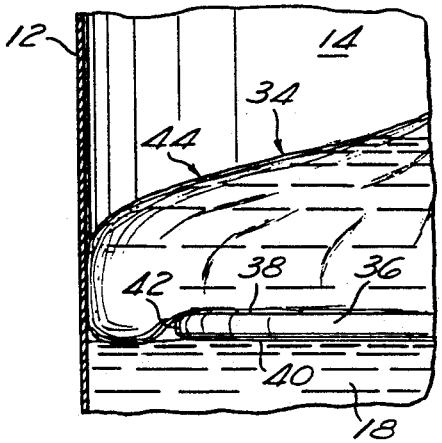

VAPOR SEAL

FIELD OF THE INVENTION

The present invention relates generally to sealing devices, and more particularly to a vapor seal for use in a container holding an air curable liquid for preventing the exposure of the surface of the liquid to air to eliminate skinning thereon when the container is stored with only a portion of the liquid therein having been utilized.

BACKGROUND OF THE INVENTION

As is well known, air curable liquids such as varnishes, stains, lacquers and paints are typically sold in a container consisting of a generally cylindrical can having a lid member secured thereto. The container is usually opened by prying the lid member off the can through the utilization of a screw driver or similar tool. In the event the entire quantity of the paint or other liquid within the container is not utilized, the lid member is typically reaffixed to the can by pounding downwardly on the peripheral edges thereof to reengage the same to the can rim.

As will be recognized, when the contents of the can are only partially used and the lid member reattached thereto, an air-filled space exists between the surface of the liquid and the bottom surface of the lid member. When the remaining quantity of the air curable liquid is stored, the presence of air between the surface of the liquid and the lid member causes the formation of a skin on the surface of the liquid which must be removed when the remaining quantity of the liquid is utilized. The necessity of having to remove the skin from the surface of the liquid is often a messy and time-consuming process which, in certain instances, also degrades the quality of the remaining liquid due to fragments of the skin being retained in suspension therein. Though such skinning generally occurs with all liquids which are air curable, problems with skinning are most frequently encountered in connection with the paint in paint cans.

The present invention recognizes the undesirability of the formation of a skin on the surface of the paint or other air curable liquid by providing a vapor seal for use in a paint can or other container which prevents such skinning from occurring.

SUMMARY OF THE INVENTION

In accordance with a first, preferred embodiment of the present invention, there is provided a vapor seal for use in a container, such as a paint can, which defines a continuous, arcuate inner surface. The vapor seal is used to prevent the surface of an air curable liquid, such as paint, within the container from being exposed to air to eliminate skinning thereon when the container is stored in a partially full state. The vapor seal of the first embodiment generally comprises a support member defining a top surface and a generally planar bottom surface. Attached to the bottom surface of the support member is a seal member which extends radially outward from the support member. The seal member, which defines a peripheral edge and a lower, liquid contacting surface, is sized and configured such that the peripheral edge is abutted and sealed against the arcuate inner surface of the container when the lower surface of the support member is floated upon the surface of the liquid therewithin. The vapor seal further includes a handle member attached to and extending upwardly from the top surface of the support member for inserting the vapor seal into and removing the vapor seal from within the container. In the first embodiment, the support member is fabricated from a rigid material such as plastic while the seal member is fabricated from a flexible material such as rubber.

In accordance with a second embodiment of the present invention, the vapor seal generally comprises a support member defining an upper surface, a lower, liquid-contacting surface and a peripheral edge. Attached to the upper surface of the support member is a fluid-filled sealing bag which is sized and configured to extend radially beyond the peripheral edge of the support member and be abutted and sealed against the inner surface of the container when the lower surface of the support member is floated upon the surface of the air-curable liquid therewithin. The sealing bag further includes a handle member formed thereon for inserting the vapor seal into and removing the vapor seal from within the container. When the vapor seal is disposed within the container and the handle member is grasped and pulled upwardly, the sealing bag is removed from its abutting contact with the inner surface of the container. In the second embodiment, the support member is preferably fabricated from plastic with the sealing bag preferably comprising a water-filled plastic bag.

In a third embodiment of the present invention, the vapor seal generally comprises a support member defining an upper surface and a lower liquid contacting surface. Attached to the upper surface of the support member is a sealing member which defines a top surface and a peripheral edge. The sealing member is sized and configured such that the peripheral edge is abutted and sealed against the inner surface of the container when the lower surface of the support member is floated upon the surface of the liquid therewithin. Attached to the top surface of the sealing member is a fluid-filled bag which is operable to maintain the lower surface of the support member in a contiguous orientation relative the surface of the liquid and the peripheral edge of the sealing member in sealed engagement to the inner surface of the container. As in the second embodiment, the bag of the third embodiment includes a handle formed thereon for inserting the vapor seal into or removing the vapor seal from within the container.

In accordance with a fourth embodiment of the present invention, the vapor seal comprises a lid member which defines a top surface and a generally planar bottom surface, and is sized and configured to be retrofittable to a container such as a conventional paint can. Attached to the lid member is a bag member defining an upper rim which is attached to the bottom surface of the lid member. In the fourth embodiment, the bag member is adapted to deploy downwardly into the container and dome into direct contact with the surface of the liquid when the lid member is attached to the container. The lid member may further include an air vent disposed therein which is selectively openable to create an open air passage between the exterior of the container and the interior of the bag member to allow the bag member to deploy downwardly into the container. As an alternative to the air vent, the bag member may be provided with a plurality of openings which are disposed about the upper rim thereof for purposes of creating open air passages between the interior of the container and the interior of the bag to allow the bag to deploy downwardly into the container when the lid member is attached thereto.

In a modified version of the fourth embodiment of the present invention, there is provided a bag member defining an upper rim which is attached to the bottom surface of the existing lid member of the container. Similar to the vapor seal described with respect to the fourth embodiment, the bag member is adapted to deploy downwardly into the container and come into direct contact with the surface of the liquid when the lid member is attached to the container. To facilitate the downward deployment of the bag member into the container, the bag member includes a plurality of openings which are disposed about the upper rim thereof for purposes of creating open air passages between the interior of the container and the interior of the bag.

BRIEF DESCRIPTION OF THE DRAWINGS

These as well as other features of the present invention will become more apparent upon reference to the drawings wherein:

FIG. 1 is a perspective view of a vapor seal constructed in accordance with a first embodiment of the present invention;

FIG. 2 is an exploded view illustrating the manner in which the vapor seal of the first embodiment is disposed within a container such as a paint can;

FIG. 3 is a cross-sectional view illustrating the manner in which the vapor seal of the first embodiment is sealed against the inner surface of the container;

FIG. 4 is a perspective view of a vapor seal constructed in accordance with a second embodiment of the present invention;

FIG. 5 is a partial cross-sectional view illustrating the manner in which the vapor seal of the second embodiment is sealed against the inner surface of the container;

DETAILED DESCRIPTION OF THE PREFERRED EMBODIMENT

Figure 6:
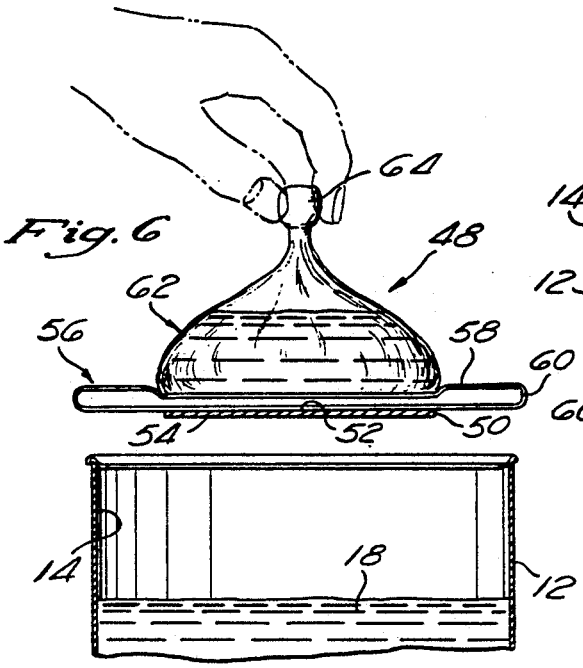
FIG. 6 is a cross-sectional view of a vapor seal constructed in accordance with a third embodiment of the present invention.

Referring now to the drawings wherein the showings are for purposes of illustrating preferred embodiments of the present invention only, and not for purposes of limiting the same, FIG. 1 perspectively illustrates a vapor seal 10 constructed in accordance with a first embodiment of the present invention. Referring now to FIGS. 1-3, in the first embodiment vapor seal 10 is adapted for use with a container 12 such as a paint can which defines a continuous, arcuate inner surface 14 and includes a lid member 16 releasably attachable thereto. The vapor seal 10 is used for preventing the surface of an air curable liquid 18, such as paint, within the container 12 from being exposed to air to eliminate skinning thereon when the container 12 is stored in a partially full state.

In the first embodiment, vapor seal 10 generally comprises a circular support member 20 defining a top surface 22 and a generally planar bottom surface 24. Attached to the bottom surface 24 of support member 20 is a seal member 26 which also has a generally circular configuration and is sized so as to extend radially outward from support member 20. Seal member 26, which defines a peripheral edge 28 and a lower, liquid contacting surface 30, is further sized having an outer diameter dimension exceeding the diameter of the inner surface 14 of the container 12 such that the peripheral edge 28 is abutted and sealed against the inner surface 14 when the lower surface 30 of the seal member 26 is floated upon the surface of the liquid 18. As seen in FIG. 3, due to the sizing of seal member 26, when the vapor seal 10 is disposed within the container 12 and properly oriented upon the surface of the liquid 18 therewithin, the peripheral edge 28 of the seal member 26 is bowed slightly upwardly by the inner surface 14 when sealed thereagainst. As further seen in FIG. 3, the thickness of the seal member 26 is substantially less than the thickness of the support member 20, thus enabling the peripheral edge 28 to bow upwardly in the aforementioned manner.

In the first embodiment, the vapor seal 10 further comprises a handle member 32 which is attached to and extends upwardly from the top surface 22 of the support member 20. As will be recognized, the handle member 32 is used to orient the vapor seal 10 within the container 12, as well as remove the vapor seal 10 from therewithin. The support member is preferably fabricated from a rigid material such as plastic, while the seal member is preferably fabricated from a flexible material such as rubber, though it will be recognized that other materials may be utilized as an alternative. The vapor seal 10 constructed in accordance with the first embodiment may be provided with the container 12 by being affixed to either the bottom of the container 12 or top of the lid member 16. Additionally, it will be recognized that in constructing the vapor seal 10, the support member 20 may be eliminated, with the handle member 32 being attached directly to the upper surface of the seal member 26. In the event the support member 20 is eliminated from the vapor seal 10, the seal member 26 will be fabricated from a flexible material having a slightly greater thickness than as depicted in FIG. 3.

Referring now to FIGS. 4 and 5, illustrated is a vapor seal 34 constructed in accordance with a second embodiment of the present invention. Vapor seal 34 comprises a generally circular support member 36 defining an upper surface 38, a lower, liquid contacting surface 40, and a peripheral edge 42. Attached to the upper surface 38 of support member 36 is a flexible, fluid-filled sealing bag 44. As best seen in FIG. 5, the sealing bag 44 is sized and configured to extend radially beyond the peripheral edge 42 of the support member 36 when the vapor seal 34 is disposed within the container 12 and the lower surface 40 of the support member 36 floated upon the surface of the liquid 18 therewithin. In this respect, due to the sizing of the sealing bag 44, the outer portion thereof extending radially beyond the peripheral edge 42 is abutted and sealed against the inner surface 14 of the container 12.

In the second embodiment, the sealing bag 44 further includes a handle member 46 formed thereon for inserting the vapor seal 34 into and removing the vapor seal 34 from within the container 12. As seen in FIG. 4, due to the flexibility of the sealing bag 44, when the handle member 46 is grasped by the user and pulled upwardly, the outer diameter dimension of the sealing bag 44 is roughly equal to the outer diameter dimension of the support member 36. When the vapor seal 34 is inserted into the container 12 and the lower surface 40 of the support member 36 floated upon the surface of the liquid 18, the release of the handle member 46 causes the fluid within the ceiling bag 44 to flow outwardly, thus causing the outer portion of the sealing bag 44 to come into abutting, sealed contact with the inner surface 14 of the container 12 in the aforementioned manner. When the handle member 46 is grasped and pulled upwardly to remove the vapor seal 34 from within the container 12, such upward pulling causes the sealing bag 44 to re-assume the configuration shown in FIG. 4, thus removing the outer portion thereof from abutting contact with the inner surface 14 of the container 12. In the second embodiment, the support member is preferably fabricated from a rigid material such as plastic. The sealing bag 44 is also preferably fabricated from plastic and filled with water. Though not shown, the sealing bag 44 may be provided with a fluid inlet to allow the same to be filled with water from a water source such as a conventional faucet.

Figure 7:
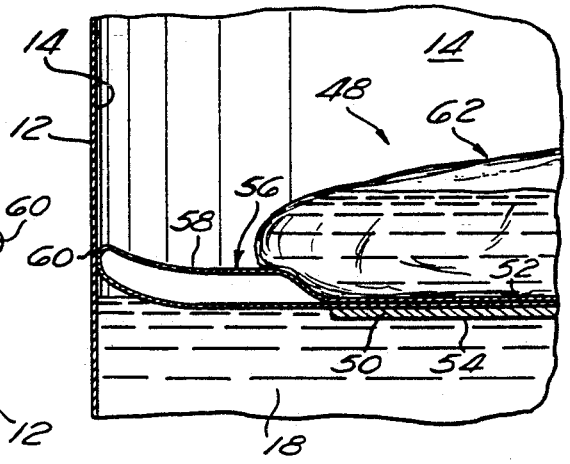
FIG. 7 is a partial cross-sectional view of the vapor seal of the third embodiment illustrating the manner in which the vapor seal is sealed against the inner surface of the container.

Referring now to FIGS. 6 and 7, illustrated is a vapor seal 48 constructed in accordance with a third embodiment of the present invention. In the third embodiment, vapor seal 48 comprises a generally circular support member 50 defining an upper surface 52 and a lower, liquid-contacting surface 54. Attached to the upper surface 52 of the support member 50 is a generally circular seal member 56 defining a top surface 58 and a peripheral edge 60. The seal member 56 is sized and configured such that the peripheral edge 60 is abutted and sealed against the inner surface 14 of the container 12 when the vapor seal 48 is inserted thereinto and the lower surface 54 of the support member 50 floated upon the surface of the liquid 18. In this respect, the seal member 56, like the seal member 26 previously discussed with respect to the first embodiment, is sized having an outer diameter dimension slightly exceeding the diameter of the inner surface 14 such that the peripheral edge 60 bows slightly upwardly when sealed against the inner surface 14, in the manner shown in FIG. 7.

Attached to the top surface 58 of seal member 56 is a flexible, fluid-filled bag 62. Unlike the sealing bag 44 previously discussed with respect to the second embodiment, the bag 62 is not utilized to form a seal against the inner surface 14, but rather is used to maintain the lower surface 54 of the support member 50 in a contiguous orientation relative the surface of the liquid 18, thus maintaining the peripheral edge 60 in sealed engagement to the inner surface 14. In this regard, the weight applied to the top surface 58 of the seal member 56 by the fluid-filled bag 62 serves to maintain the vapor seal 48 in the aforementioned orientation and aids in preventing the vapor seal 48 from shifting position within the container 12 as could occur when the container 12 is moved in a manner causing a displacement of the liquid 18.

Formed on the bag 62 is a handle member 64 which is used to insert the vapor seal 48 into the container 12 as well as remove the vapor seal 48 from therewithin. In the third embodiment, the support member 50 is preferably fabricated from a rigid material such as plastic, while the sealing member 56 is preferably fabricated from a flexible material such as rubber. Additionally, the bag 62 is preferably fabricated from plastic and filled with water. Though not shown, the bag 62 may be provided with a fluid inlet to allow the same to be filled with water from a conventional water source such as a faucet.

Referring now to FIGS. 8–11, illustrated is a fourth embodiment of the present invention comprising a vapor seal 66 for use in conjunction with the container 12. Vapor seal 66 generally comprises a lid member 68 defining a top surface 70 and a generally planar bottom surface 72. In the fourth embodiment, lid member 68 is particularly sized and configured to be retrofittable to the container 12 and thus, includes a flange 74 formed about the periphery thereof which is releasably engageable to the rim 76 of the container 12 in a conventional manner.

Figure 8:
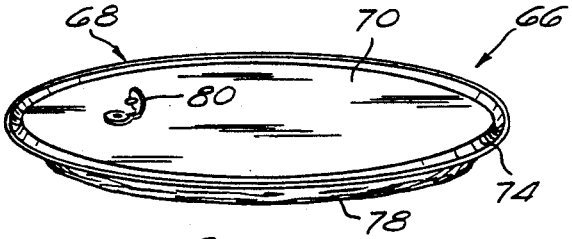
FIG. 8 is an upper perspective view of a vapor seal constructed in accordance with a fourth embodiment of the present invention.
Figure 9:
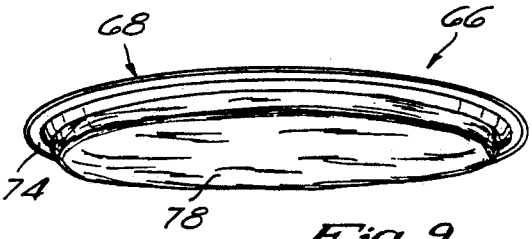
FIG. 9 is a lower perspective view of the vapor seal shown in FIG. 8.
Figure 10:
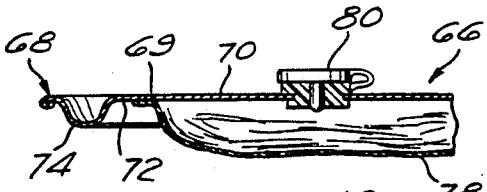
FIG. 10 is a partial cross-sectional view of an air vent used to deploy the vapor seal of the fourth embodiment into the container.
Figure 11:
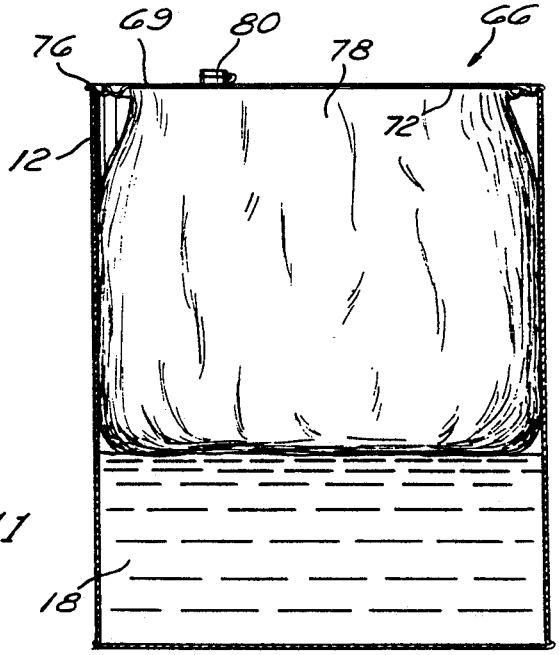
FIG. 11 is a cross-sectional view illustrating the vapor seal shown in FIGS. 8 and 9 as deployed within the container.

Vapor seal 66 further comprises a bag member 78 having an upper rim 69 which is attached to the bottom surface 72 of the lid member 68. As seen in FIG. 11, the bag member 78 is adapted to deploy downwardly into the interior of the container 12 and come into direct contact with the surface of the liquid 18 therewithin when the lid member 68 is attached to the rim 76 of the container 12. Prior to its deployment into the interior of the container 12, the bag member 78 is attached to the bottom surface 72 in a collapsed configuration as seen in FIGS. 8–10, and may be vacuum-sealed thereagainst. To facilitate the downward deployment of the bag member 78 into the container 12, disposed within the lid member 68 is an air vent 80 which is normally closed (as seen in FIG. 10), but selectively openable (as seen in FIG. 8) so as to create an open air passageway from the exterior of the container 12 into the interior of the bag member 78. As will be recognized, when the lid member 68 is attached to the container 12, the open air passage created by the opening of the air vent 80 places the interior of the bag in fluid communication with ambient air thus allowing the same to expand downwardly into the interior of the container 12.

As an alternative to incorporating the air vent 80 into the lid member 68, the bag member 78 may be provided with a plurality of openings disposed about the upper rim 69 thereof. In this respect, when the lid member is attached to the container 12, these openings create open air passageways between the interior of the container 12 and the interior of the bag member 78, thus allowing the bag member 78 to deploy downwardly into the container 12. As will be recognized, the direct contact of the lower portion of the bag member 78 against the surface of the liquid 18 within the container 12 serves to prevent the formation of skin thereon. When the liquid 18 remaining within the container 12 is to be utilized, the lid member 68 is removed from the container 12 in a conventional manner, with both the lid member 68 and bag member 78 attached thereto being discarded. In the fourth embodiment, the bag member is preferably fabricated from plastic, though other materials may be utilized as an alternative.

In a modified version of the fourth embodiment, the vapor seal comprises the bag member 78 exclusive of the lid member 68. In this respect, the bag member 78 is attached to the bottom surface of the lid member originally provided with the container 12. Since such lid member will not include an air vent 80 disposed therein, the bag member 78 attached thereto may be caused to deploy downwardly into the container 12 by punching a hole in the existing lid member to create an open air passageway between the exterior of the container 12 and the interior of the bag member 78. Alternatively, as previously discussed with respect to the fourth embodiment, the bag member 78 may be provided with a plurality of openings disposed about the upper rim 69 thereof which, when the lid member is re-attached to the container 12, are operable to create open air passages between the interior of the container 12 and the interior of the bag member 78 to cause the same to deploy downwardly into the container 12.

Additional modifications and improvements of the present invention may also be apparent to those skilled in the art. Thus, the particular combination of parts described and illustrated herein is intended to represent only one embodiment of the invention, and is not intended to serve as limitations of alternative devices within the spirit and scope of the invention.

What is claimed is:

1. A vapor seal for use in a container defining a continuous, arcuate inner surface, for preventing the surface of an air curable liquid within the container from being exposed to air to eliminate skinning thereon when the container is stored, comprising:

a support member defining an upper surface, a lower liquid contacting surface and a peripheral edge; and a flexible, fluid-filled sealing bag attached to and extending completely across the upper surface of said support member, said sealing bag being sized and configured to press downwardly upon said support member, to extend radially beyond said peripheral edge of said support member and be abutted and sealed against said inner surface of said container when said lower surface of said support member is floated upon the surface of the air curable liquid, said sealing bag includes a handle member formed thereon for inserting the vapor seal into and removing the vapor seal from within the container, said sealing bag being removed from abutting contact with said inner surface when said handle member is grasped and pulled upwardly.

2. The device of claim 1 wherein said support member has a generally circular configuration and is fabricated from plastic.

3. The device of claim 1 wherein said sealing bag is filled with water.

* * * * *